US006659575B2

(12) United States Patent
Hellman et al.

(10) Patent No.: US 6,659,575 B2
(45) Date of Patent: Dec. 9, 2003

(54) CABINET COVER CONSTRUCTION FOR FORMED SHEET METAL CABINETS

(75) Inventors: Nathan Thomas Hellman, Olathe, KS (US); Kevin Michael Kraus, Jesup, IA (US); Greg Jon Holcomb, Cedar Falls, IA (US); Daniel Lee Jackson, Center Point, IA (US)

(73) Assignee: Waterloo Industries, Inc., Waterloo, IA (US)

( * ) Notice: Subject to any disclaimer, the term of this patent is extended or adjusted under 35 U.S.C. 154(b) by 0 days.

(21) Appl. No.: 10/120,861

(22) Filed: Apr. 11, 2002

(65) Prior Publication Data

US 2003/0193278 A1 Oct. 16, 2003

(51) Int. Cl.[7] ..... A47B 49/00
(52) U.S. Cl. ..... 312/326; 292/202

(58) Field of Search ..... 312/326, 327, 312/328, 329; 292/202

(56) References Cited

U.S. PATENT DOCUMENTS 3,321,117 A * 5/1967 Hedin ..... 223/107
4,238,063 A * 12/1980 O'Dair ..... 206/315.1
4,778,229 A * 10/1988 Polidoro ..... 312/326

* cited by examiner

*Primary Examiner*—Ramon O. Ramirez
(74) *Attorney, Agent, or Firm*—Banner & Witcoff, Ltd.

(57) ABSTRACT

A cabinet cover construction for a formed sheet metal cabinet includes a front edge with two angled surfaces that are congruent with compatible angled surfaces of the top edge of the cabinet to ensure alignment of a closed cover on the cabinet and to prevent overbite of the cover upon closing thereof.

5 Claims, 3 Drawing Sheets

CABINET COVER CONSTRUCTION FOR FORMED SHEET METAL CABINETS

BACKGROUND OF THE INVENTION

In a principal aspect the present invention relates to a cabinet cover construction for a sheet metal cabinet and, more particularly, to the construction of the front edge of the cabinet cover and the top edge of the cabinet panel that joins with the cabinet cover when the cover is in the closed position.

Sheet metal cabinets are utilized for many purposes. For example, such cabinets are used for tool storage, as pharmaceutical cabinets, as dental cabinets, and as general storage cabinets. Typically such cabinets include multiple metal drawers arranged in a vertical array, one above the other. Often such a cabinet construction also includes a hinged top cover that permits access to the top of the cabinet and that may serve as a work surface or enclose an additional storage area or both. Such covers are typically formed from sheet metal by a stamping process. Hinges are formed or welded on the backside of the cover for hinged attachment of the cover onto the backside of the cabinet. In this manner the cover may be closed over the top of the cabinet. Most typically, the cover includes vertical front, back and side edges to facilitate the formation of a covered enclosure on the top of the cabinet.

A problem that often exists with such constructions is known as "overbite" of the cabinet cover. Because the cabinet cover is formed from sheet metal, which is somewhat flexible particularly in larger sizes of covers, the front edge of the cover may tend to roll over the top edges of the vertical panels forming the cabinet itself. Thus there has remained an "overbite" problem in the design of cabinet covers for sheet metal cabinets.

SUMMARY OF THE INVENTION

Briefly, the present invention comprises a cabinet cover construction for a formed sheet metal cabinet of the type having a vertical front panel with a top edge and a cover panel with a front, vertically depending edge designed to engage with, mate with, and cooperate with the top edge of the vertical front panel. More specifically the top edge of the vertical panel includes an inwardly extending horizontal run having an inwardly and downwardly angled run extending therefrom. The front, vertically depending edge of the cover, which engages against the top edge of the front panel, also includes an inwardly extending horizontal run and a downwardly depending, angled run as well as a further inwardly extending, horizontal run that terminates on the inside of the cabinet cover. The cabinet cover, when in a closed position, is designed so that the runs when viewed in cross section fully overlap one another. The angled runs thus have common angles and a common apex. As a result, when the top cover is closed with the front edge thereof against the top edge of the front panel, the arrangement of the horizontal and angled runs insures that the cabinet parts will mesh together in a manner that precludes undesirable overbite. Additionally, the second inward extending horizontal run on the inside of the cover provides a strike for engagement by a bolt to thereby facilitate locking the cover in a closed position. Thus it is an object of the invention to provide an improved cabinet cover construction for a formed sheet metal cabinet.

It is a further object of the invention to provide a cabinet cover construction for a formed sheet metal cabinet, which prevents the occurrence of "overbite".

Another object of the invention is to provide a cabinet cover construction for a formed metal sheet cabinet, which is easily manufactured and easily incorporated in sheet metal cabinet constructions.

Another object of the invention is to provide an improved cabinet cover construction for a formed metal cabinet which is economical, rugged, and which may be incorporated easily into preexisting cabinet constructions.

These and other objects, advantages, and features of the invention will be set forth in the detailed description which follows.

BRIEF DESCRIPTION OF THE DRAWING

In the detailed description that follows, reference will be made to the drawing comprised of the following figures.

DESCRIPTION OF THE PREFERRED EMBODIMENT

Figure 1:
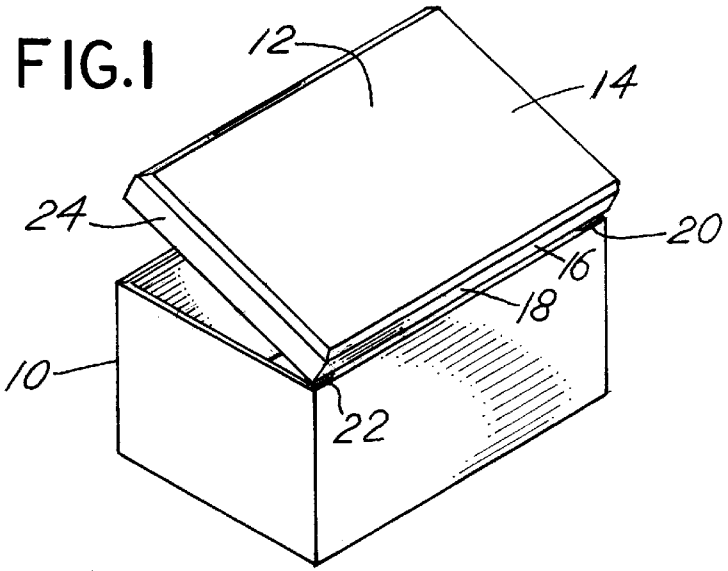
FIG. 1 is an isometric view of a typical sheet metal cabinet construction having a cover and including the cabinet cover construction of the present invention.

Referring to the figures, and in particular FIG. 1, there is disclosed a typical sheet metal cabinet construction comprising panels forming a generally rectangular, parallelepiped base cabinet 10 with a cover 12 formed of sheet metal. Cover 12 includes a planar top panel 14, a peripheral depending circumferential rim or edge 16 including a back edge section 18 attached by first and second hinges 20 and 22 to the back vertical panel or cabinet 10. The cover 12 pivots about the hinges 20 and 22 and fits over top of the cabinet 10. The peripheral depending edge 16 includes a first side edge 24 and an opposite side edge (not shown) and a front edge or downwardly depending, vertical run 26. The front edge 26 fits against and cooperates with a vertical panel 30 having a top edge 32.

Figure 2:
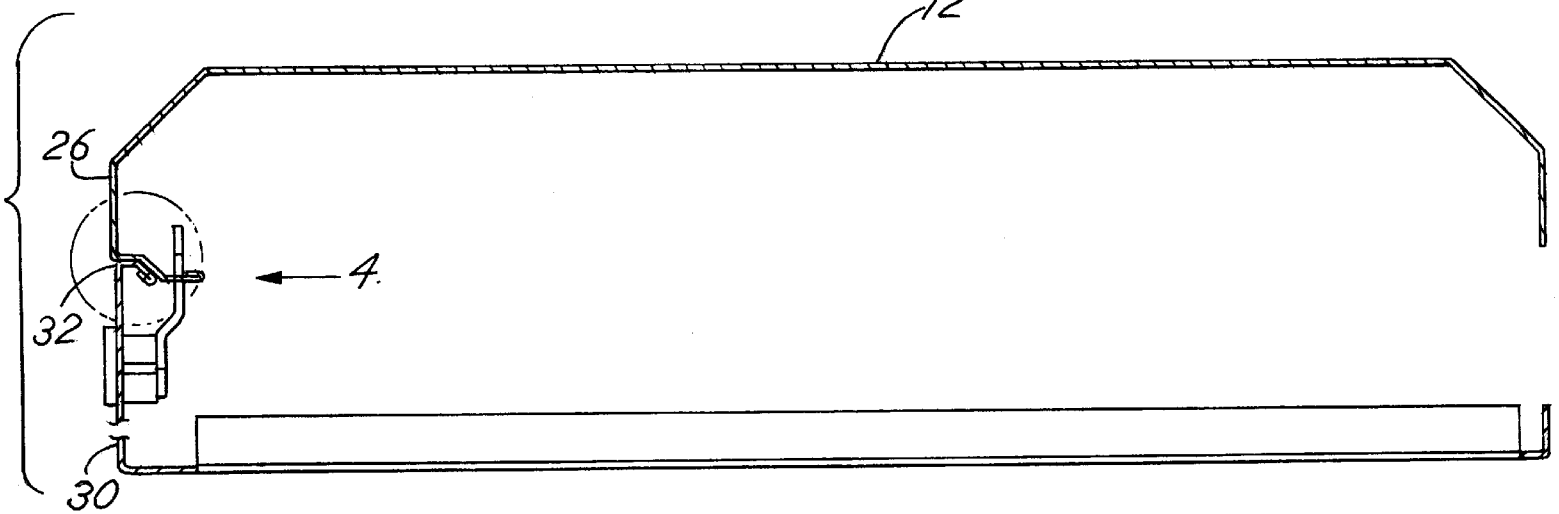
FIG. 2 is a cross sectional view of the cabinet cover incorporated in the cabinet of FIG. 1.
Figure 4:
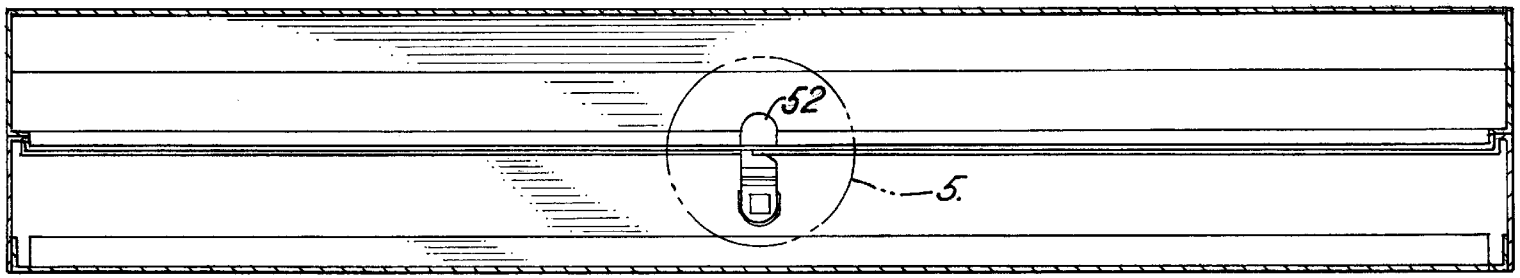
FIG. 4 is an elevation of the cabinet cover construction of FIG. 2 as viewed in the direction of the arrow, 4, in FIG. 2.
Figure 5:
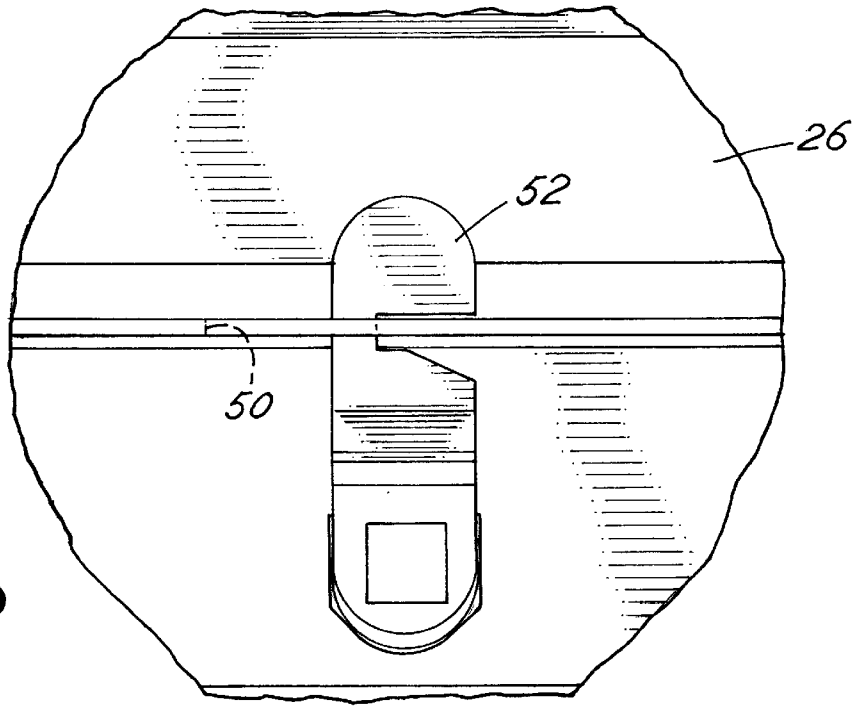
FIG. 5 is an enlarged view of the lock mechanism depicted in FIG. 4 illustrating a strike and bolt combination.
Figure 6:
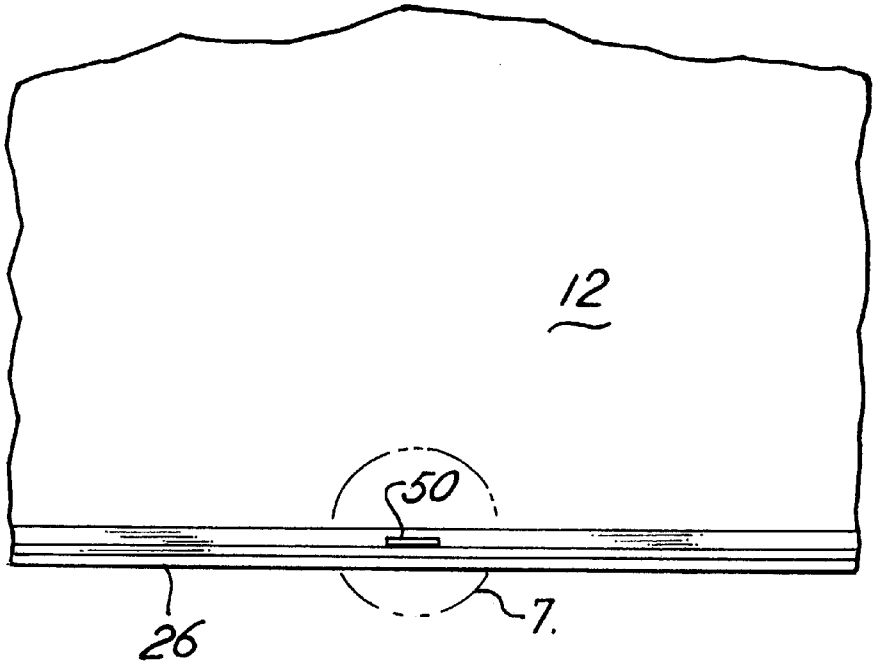
FIG. 6 is a bottom plan view of the cabinet cover.
Figure 7:
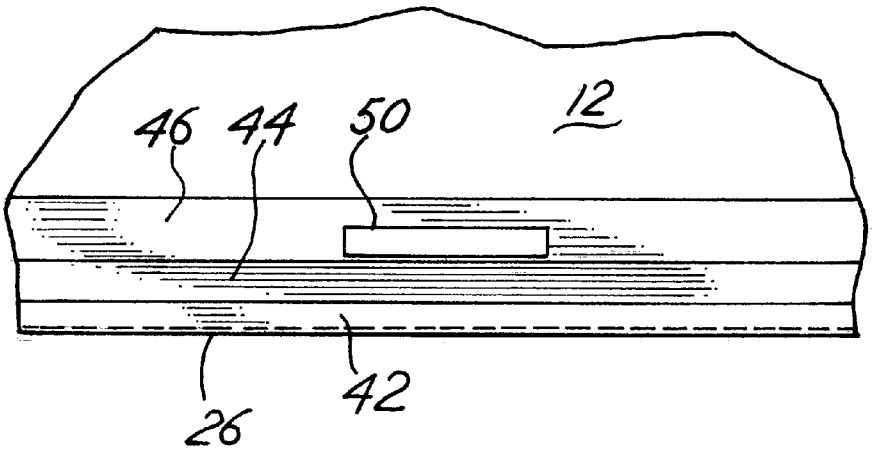
FIG. 7 is an enlarged view of the strike incorporated in the cover of FIG. 6.

FIG. 2 depicts a typical cover 12 in combination with the top of cabinet 10. The invention relates to the combination of the cover 12 with a cabinet 10 and, more particularly, to the construction of the front edge 26 of the cover 12 and the manner in which it cooperates with, and engages with, the top edge 32 of the front panel 30.

Figure 3:
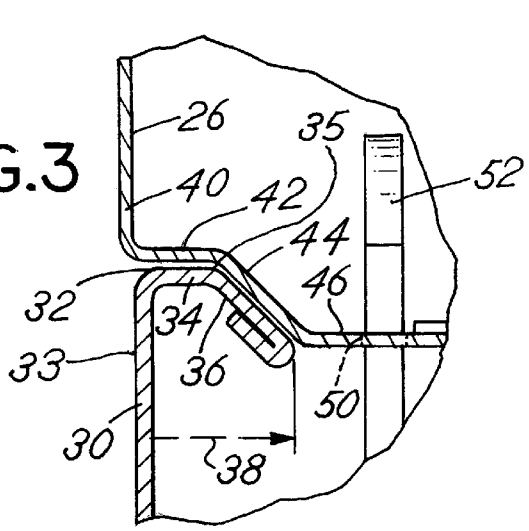
FIG. 3 is an enlarged view of the top and front edge construction of the cabinet cover of FIG. 2.

Referring therefore to FIG. 3, the front panel 30 includes a vertical run 33 which connects with a first horizontal run 34 that extends inwardly into the cabinet 10. The first run 34, in turn, is connected with a depending, angled run 36 that forms an acute angle with the run 34. The angle is preferably in the range of 20 to 75° and, most preferably, about 30°. The second run 36 extends inwardly from junction 35 with run 34 and the front panel 30 by a distance 31 and terminates. As depicted in FIG. 3, the second run 36 may be folded over on its inward edge to enhance the rigidity or structural integrity of the top edge 32 of the panel 30.

The front edge 26 of the cover 12 includes a downwardly depending panel or face edge 40 connected with an inwardly extending, third horizontal run 42 connected to a depending, angled fourth run 44 at a junction 45. When the cover 12 is in the closed position, the third run 42 is generally coextensive with and overlies the first run 34 and the fourth run 44 is generally coextensive with and overlies the second run 36 so that junctions 35 and 45 are congruent.

The inwardly extending edge of the cover 12 further includes a fifth generally horizontal run 46 which extends inwardly from fourth run 44 into the interior of the region defined by the cover 12. Fifth run 46 includes a slot 50 which defines a strike for cooperation with a bolt 52. It should be noted that the slot strike 50 is generally a rectangular elongate slot parallel to the front panel 30. The slot 50 may have other shapes and may be angled so as to more tightly bind the third and fourth runs 42 and 44 against the first and second runs 34 and 36. In the preferred embodiment, however, the slot 50 is generally parallel to the plane of the front panel 30.

Generally the front panel 30 and the front face or edge 26 of the cover 12 are coplanar or, if desired, they may be arranged to be non-coplanar as in FIG. 3. Importantly the cross sectional shape of the first and second runs 34 and 36 is compatible and tightly overlies with the third and fourth runs 42 and 44 whereby the top edge 26 will properly mate with and fit onto the top edge 32 of the front panel 30 and avoid either shifting outwardly or inwardly. The top edge 26 will thus properly mate with and fit onto the top edge 32 of the front panel 30 and avoid either shifting outwardly or inwardly thereby avoiding any "overbite" of the cover 12.

In the preferred embodiment, the described construction is utilized with respect to the front edge 26 of the cover 12. Such arrangement is adequate to maintain proper alignment of the cover 12. It is possible to utilize a construction of the type depicted on the side or lateral edges of the cover 12 as well as the front edge 26 to provide a more complete seal of the cover onto the top of the cabinet. The runs 34, 36, 42, 44 are preferably coextensive with the full length of the top edge 30, but may alternatively be less or made up of a series of segments which are spaced from each other along the edges of the cover 12. Other variations of the construction may also be utilized. The angle of the second and fourth runs 36 and 44 may be varied and those runs may be arcuate in shape. Importantly, the junctions 35 and 45 overlap when the cover 12 is in the proper position. The fifth run 46 is depicted as horizontal but may be angled without departing from the spirit and scope of the invention. The invention is therefore to be limited only by the following claims or equivalents thereof.

What is claimed is:

1. In a formed sheet metal cabinet having a vertical front panel with a top edge and a top cover panel with a front edge that closes against the cabinet top edge, the improvement comprising, in combination:

said cabinet top edge including a first horizontal run extending inwardly from the cabinet top edge, and a second run extending downwardly from the first run at a fixed acute angle, and terminating at a first distance inward from the vertical front panel;

said cover panel front edge of said cover generally aligned with the cabinet front panel top edge when the cover is in the closed position, said cover panel front edge further including a third horizontal run overlying and congruent with the cabinet top edge first run when the cover panel is in the closed position; and said cover panel front edge further including a fourth run extending downwardly from the third run at said fixed acute angle of said cabinet second run and overlying the second run when the cover panel is in the closed position, whereby the cabinet top edge is aligned with the cover panel front edge to preclude overbite of the cover panel upon closure.

2. The construction of claim 1 wherein the cover panel front edge further includes a fifth run extending horizontally from the fourth run for a second fixed distance, said fifth run including a strike opening for a bolt.

3. The construction of claim 1 wherein each fixed acute angle is between 20° and 75°.

4. The construction of claim 2 wherein the strike comprises a slot in the fifth run.

5. The construction of claim 1 wherein each fixed acute angle is about 30°.

* * * * *